US005817372A

United States Patent [19]

Zheng

[11] Patent Number: 5,817,372

[45] Date of Patent: Oct. 6, 1998

[54] PROCESS FOR DEPOSITING A BOND COAT FOR A THERMAL BARRIER COATING SYSTEM

[75] Inventor: Xiaoci Maggie Zheng, Clifton Park, N.Y.

[73] Assignee: General Electric Co., Schenectady, N.Y.

[21] Appl. No.: 935,534

[22] Filed: Sep. 23, 1997

[51] Int. Cl.[6] ..... C23C 4/06; C23C 4/12

[52] U.S. Cl. ..... 427/456; 427/454; 427/455

[58] Field of Search ..... 427/455, 456, 427/454

[56] References Cited

U.S. PATENT DOCUMENTS

| | | | |
|---|---|---|---|
| 5,236,745 | 8/1993 | Gupta et al. | 427/454 |
| 5,277,936 | 1/1994 | Olson et al. | 427/456 |
| 5,362,523 | 11/1994 | Gorynin et al. | 427/454 |

*Primary Examiner*—Katherine A. Bareford
*Attorney, Agent, or Firm*—Domenica N. S. Hartman; Robert C. Lampe, Jr.

[57] ABSTRACT

A method of depositing a bond coat (16) of a thermal barrier coating (TBC) system (14) for components designed for use in a hostile thermal environment, such as turbine, combustor and augmentor components (10) of a gas turbine engine. The method yields a bond coat (16) having an adequate surface roughness for adhering a plasma-sprayed ceramic layer (18) while also producing a bond coat (16) that is dense with low porosity, thereby yielding a thermal barrier coating system (14) that is highly resistant to spallation. The method generally entails forming the bond coat (16) by depositing two metal powders on the substrate (12) using either a vacuum plasma spraying (VPS) or high velocity oxy-fuel (HVOF) technique. The particle size distributions of the two powders are chosen to yield a bimodal (dual-peak) particle size distribution that will produce a VPS and HVOF bond coat (16) characterized by a macro-surface roughness of at least about 350 microinches Ra attributable to particles of the coarser powder. The particles of the finer powder fill the interstices between particles of the coarser powder to achieve a density of at least about 95% of theoretical density, and contribute to a micro-surface roughness that, in combination with the macro-surface roughness provided by the coarser particles, enhances adhesion of the ceramic layer (18).

16 Claims, 1 Drawing Sheet

PROCESS FOR DEPOSITING A BOND COAT FOR A THERMAL BARRIER COATING SYSTEM

FIELD OF THE INVENTION

The present invention relates to protective coatings for components exposed to high temperatures, such as components of a gas turbine engine. More particularly, this invention is directed to a process for forming a bond coat of a thermal barrier coating system, and specifically those coating systems employing a thermally-sprayed thermal-insulating layer.

BACKGROUND OF THE INVENTION

The operating environment within a gas turbine engine is both thermally and chemically hostile. Significant advances in high temperature alloys have been achieved through the formulation of iron, nickel and cobalt-base superalloys, though components formed from such alloys often cannot withstand long service exposures if located in certain high-temperature sections of a gas turbine engine, such as the turbine, combustor or augmentor. Examples of such components include buckets and nozzles in the turbine section of a gas turbine engine. A common solution is to protect the surfaces of such components with an environmental coating system, such as an aluminide coating, an overlay coating or a thermal barrier coating system (TBC). The latter includes a layer of thermal-insulating ceramic adhered to the superalloy substrate with an environmentally-resistant bond coat.

Metal oxides, such as zirconia ($ZrO_2$) that is partially or fully stabilized by yttria ($Y_2O_3$), magnesia (MgO) or another oxide, have been widely employed as the material for the thermal-insulating ceramic layer. The ceramic layer is typically deposited by air plasma spray (APS), vacuum plasma spray (VPS), also called low pressure plasma spray (LPPS), or a physical vapor deposition (PVD) technique, such as electron beam physical vapor deposition (EBPVD) which yields a strain-tolerant columnar grain structure. APS is often preferred over other deposition processes because of low equipment cost and ease of application and masking. Notably, the adhesion mechanism for plasma-sprayed ceramic layers is by mechanical interlocking with a bond coat having a relatively rough surface, preferably about 350 microinches to about 750 microinches (about 9 to about 19 $\mu$m) Ra.

Bond coats are typically formed from an oxidation-resistant alloy such as MCrAlY where M is iron, cobalt and/or nickel, or from a diffusion aluminide or platinum aluminide that forms an oxidation-resistant intermetallic, or a combination of both. Bond coats formed from such compositions protect the underlying superalloy substrate by forming an oxidation barrier for the underlying superalloy substrate. In particular, the aluminum content of these bond coat materials provides for the slow growth of a dense adherent aluminum oxide layer (alumina scale) at elevated temperatures. This oxide scale protects the bond coat from oxidation and enhances bonding between the ceramic layer and bond coat.

Aside from those formed by diffusion techniques and physical or chemical vapor deposition, bond coats are typically applied by thermal spraying, e.g., APS, VPS and high velocity oxy-fuel (HVOF) techniques, all of which entail deposition of the bond coat from a metal powder. The structure and physical properties of such bond coats are highly dependent on the process and equipment by which they are deposited. Little oxidation of the metal particles occurs during deposition by VPS methods, such that the resulting bond coats are dense and free of oxides, and therefore have a high temperature capability (e.g., above 1000° C. (about 1800° F.)) because of their ability to grow a continuous protective oxide scale. Because of a relatively low heat capacity to melt the spray powder, VPS processes typically employ powders having a very fine particle size distribution, with the result that as-sprayed VPS bond coats are dense but have relatively smooth surfaces (typically 200 to 350 microinches (about 4 to about 9 $\mu$m)). Consequently, plasma-sprayed ceramic layers do not adhere well to VPS bond coats.

In contrast, air plasma possesses a higher heat capacity in the presence of air. The higher heat capacity of the APS process enables the melting of relatively large particles, permitting the use of metal powders that yield bond coats having a rougher surface than is possible with VPS. The adhesion of a ceramic layer to an APS bond coat is enhanced by the rough APS bond coat surface, e.g., in the 350 to 700 microinch range suitable for plasma-sprayed ceramic layers. The particle size distribution of such powders is Gaussian as a result of the sieving process, and are typically broad in order to provide finer particles that fill the interstices between larger particles to reduce porosity. However, the finer particles are prone to oxidation during the spraying process, resulting in a bond coat having a very high oxide content. The low momentum possessed by the sprayed particles in the APS process also promotes porosity in the coating. Consequently, as-sprayed APS bond coats inherently contain relatively high levels of oxides and are more porous than are VPS bond coats. Because of their higher level of oxides and porosity, APS bond coats are more prone to oxidation than are VPS bond coats.

Bond coats deposited by HVOF techniques are very sensitive to particle size distribution of the powder because of the relatively low spray temperature of the HVOF process. Accordingly, HVOF process parameters have been typically adjusted to spray powders having a very narrow range of particle size distribution. To produce a bond coat using an HVOF process, a coarse powder must typically be used in order to achieve adequate surface roughness. However, because coarse particles cannot typically be fully melted at suitable HVOF parameters, HVOF bond coats of the prior art have typically exhibited relatively high porosity and poor bonding between sprayed particles.

In view of the above, it can be seen that, while bond coats deposited by various techniques have been successfully employed, each has advantages and disadvantages that must be considered for a given application. In particular, while APS processes readily yield a bond coat having adequate surface roughness to adhere a plasma-sprayed ceramic layer, porosity and the tendency for oxidation in such bond coats are drawbacks to the protection and adhesion they provide to the underlying substrate. Accordingly, what is needed is a process by which the surface roughness necessary for a plasma-sprayed ceramic layer can be achieved for a bond coat while also achieving reduced porosity and oxidation.

SUMMARY OF THE INVENTION

According to the present invention, there is provided a method of depositing a bond coat of a thermal barrier coating (TBC) system for components designed for use in a hostile thermal environment, such as turbine buckets and nozzles, combustor components, and augmentor components of a gas turbine engine. The method yields a bond coat having an adequate surface roughness for adhering a plasma-sprayed ceramic layer, while also producing a bond coat that is dense with low oxide content. Consequently, bond coats produced by the method of this invention are protective and yield thermal barrier coating systems that are highly resistant to spallation.

The method generally entails forming a bond coat on a substrate by depositing metal powders on the substrate using either a vacuum plasma spraying (VPS) or high velocity oxy-fuel (HVOF) technique. According to the invention, a bimodal (dual-peak) particle size distribution must be achieved in order to yield a VPS or HVOF bond coat that exhibits adequate surface roughness for a plasma-sprayed ceramic layer, yet also exhibits high density and low oxide content. For this purpose, a combination is used of finer and coarser powders that are deposited separately, combined to form a powder mixture prior to deposition, or a combination of the two. For example, the finer and coarser powders can be sequentially or simultaneously deposited, or combined and then deposited, or a portion of the finer powder can be deposited first followed by the application of a mixture of the finer and coarser powders. The powders may be of the same or different oxide scale-forming metal alloys, such as aluminum-containing intermetallics, chromium-containing intermetallics, MCrAl and MCrAlY. In the case where a premixed powder is used, the surface roughness of the bond coat is attributable to particles of the coarser powder being incompletely melted during deposition, yielding a macro-surface roughness of at least about 350 microinches (about 9 $\mu$m) Ra. The particles of the finer powder have been found to fully melt and fill the interstices between particles of the coarser powder to a degree sufficient to achieve a density of at least about 95% of theoretical density. The finer powder also contributes to the micro-surface roughness of the bond coat, which has been determined to greatly enhance the adhesion of the thermal barrier coating when combined with the macro-surface roughness provided by the coarser powder. According to the invention, the bond coat must be heat treated following deposition to diffusion bond the particles of the two powders.

From the above, it can be seen that the method of this invention produces a bond coat having a surface roughness necessary for a plasma-sprayed ceramic layer of a TBC system, while also achieving reduced porosity and oxidation. Accordingly, bond coats produced by the present invention are able to adhere plasma-sprayed ceramic layers, such that the TBC system exhibits a desirable level of spallation resistance while inhibiting oxidation of the underlying substrate.

Other objects and advantages of this invention will be better appreciated from the following detailed description.

DETAILED DESCRIPTION OF THE INVENTION

Figure 1:
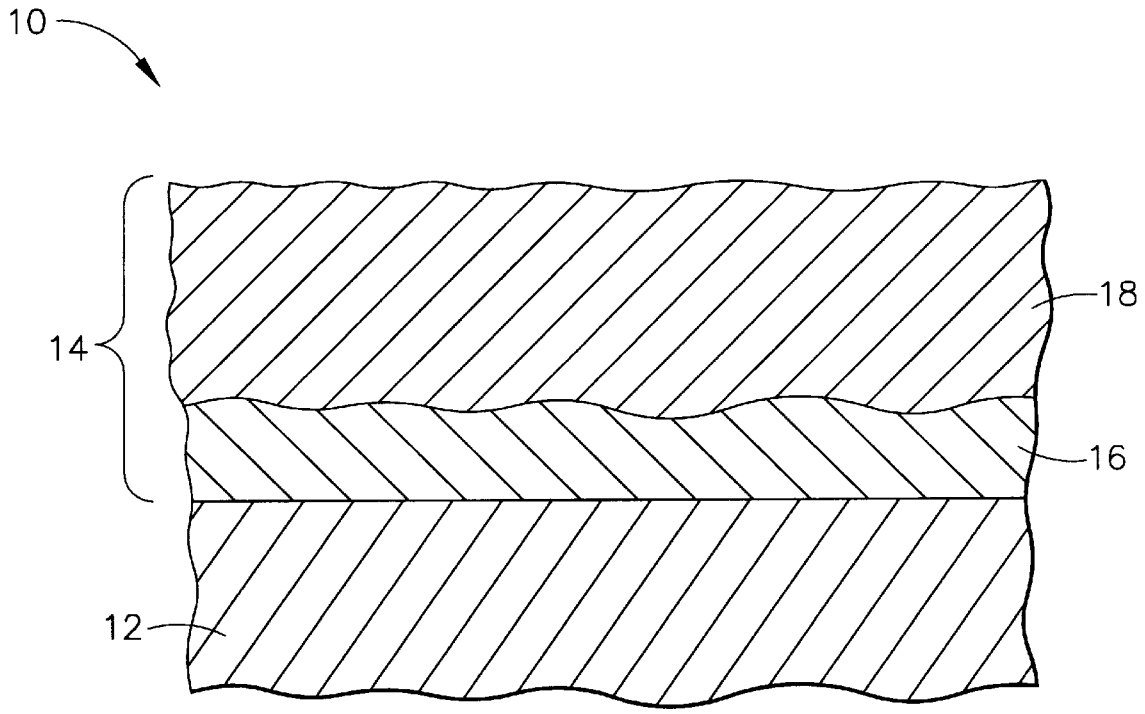
FIG. 1 schematically represents a thermal barrier coating system having a bond coat deposited by a vacuum plasma spray or high velocity oxy-fuel process in accordance with this invention.

The present invention is generally applicable to metal components that are protected from a thermally and chemically hostile environment by a thermal barrier coating (TBC) system. Notable examples of such components include the high and low pressure turbine nozzles and blades, shrouds, combustor liners and augmentor hardware of gas turbine engines, and buckets of industrial turbine engines. While the advantages of this invention are particularly applicable to turbine engine components, the teachings of this invention are generally applicable to any component on which a thermal barrier may be used to thermally insulate the component from its environment.

A partial cross-section of a turbine engine component 10 having a thermal barrier coating system 14 in accordance with this invention is represented in FIG. 1. The coating system 14 is shown as including a thermal-insulating ceramic layer 18 bonded to a substrate 12 with a bond coat 16. As is the situation with high temperature components of a turbine engine, the substrate 12 may be formed of an iron, nickel or cobalt-base superalloy, though it is foreseeable that other high temperature materials could be used. According to this invention, the ceramic layer 18 is deposited by plasma spraying techniques, such as air plasma spraying (APS) and vacuum plasma spraying (VPS), also known as low pressure plasma spraying (LPPS) A preferred material for the ceramic layer 18 is an yttria-stabilized zirconia (YSZ), though other ceramic materials could be used, including yttria, partially stabilized zirconia, or zirconia stabilized by other oxides, such as magnesia (MgO), ceria ($CeO_2$) or scandia ($Sc_2O_3$).

The bond coat 16 must be oxidation-resistant so as to be capable of protecting the underlying substrate 12 from oxidation and to enable the plasma-sprayed ceramic layer 18 to more tenaciously adhere to the substrate 12. In addition, the bond coat 16 must be sufficiently dense and have relatively low levels of oxides to further inhibit oxidation of the substrate 12. Prior to or during deposition of the ceramic layer 18, an alumina ($Al_2O_3$) scale (not shown) may be formed on the surface of the bond coat 16 by exposure to elevated temperatures, providing a surface to which the ceramic layer 18 tenaciously adheres. For this purpose, the bond coat 16 preferably contains alumina- and/or chromia-formers, i.e., aluminum, chromium and their alloys and intermetallics. Preferred bond coat materials include MCrAl and MCrAlY, where M is iron, cobalt and/or nickel.

Finally, because the ceramic layer 18 is deposited by plasma spraying, the bond coat 16 must have a sufficiently rough surface, preferably at least 350 microinches (about 9 $\mu$m) in order to mechanically interlock the ceramic layer 18 to the bond coat 16. Contrary to the prior art, the process of this invention does not employ an APS process to form the bond coat 16. Instead, the present invention produces a bond coat 16 having sufficient surface roughness using a VPS or a high velocity oxy-fuel (HVOF) process. Notably, prior art VPS bond coats are too smooth to adequately adhere a plasma-sprayed bond coat, and prior art HVOF bond coats have been produced with adequate surface roughness but at the expense of lower coating densities and poor integrity.

In order to obtain a VPS or HVOF bond coat 16 that has desirable surface roughness while also exhibiting high density and low oxide levels, the deposition process of this invention employs metal powders that provide for a bimodal (dual-peak) particle size distribution. For this purpose, two metal powders with different particle size distributions are employed, one being relatively fine and the other relatively coarse, i.e., the finer powder has a smaller average particle size than the coarser powder. Preferably, at least 90 percent of the particles of the finer powder are smaller than those of the coarser powder. The powders can be combined to form a powder mixture prior to spraying or mixed during the spraying process. Alternatively, the powder mixture could be obtained by other methods, such as a double sieving process during powder production. A preferred method entails forming the bond coat 16 to have a layer formed essentially of the finer powder, and an outer layer formed by a mixture of the finer and coarser powders. The advantage of this coating structure is that the portion of the bond coat 16 formed entirely of the finer powder provides a very dense barrier to oxidation, while the combination of the finer and coarser powders forms an outer layer having a higher density than that possible with only the coarser powder, and an outer surface characterized by a micro-roughness attributable to the finer powder and a macro-roughness attributable to the coarser powder. The combination of micro- and macro-roughness has been found to promote the mechanical interlocking capability of the bond coat 16 with the subsequently-applied ceramic layer 18.

A sufficient amount of the coarser powder must be deposited to produce an adequate surface macro-roughness for the bond coat 16, while the proportion of the finer powder must be sufficient to yield an adequate surface micro-roughness for adhesion of the ceramic layer 18 and also fill the interstices between the coarser particles to increase the density of the bond coat 16. A preferred bond coat 16 is formed of about 20 to about 80 volume percent of the finer powder, with the remainder being the coarser powder. The finer powder has a preferred particle size distribution of about 5 to about 45 μm, while the coarser powder has a preferred particle size distribution of about 45 to about 120 μm. According to this invention, the above conditions are able to yield a VPS or HVOF bond coat 16 having a surface roughness of about 350 microinches to about 750 microinches (about 9 to about 19 μm) Ra, and a density of at least about 95% of theoretical.

During the evaluation of this invention, it was determined that VPS and HVOF deposition techniques could be carried out to fully melt the particles of the finer powder without generating an unacceptable level of oxides. Generally, the oxide content of bond coats 16 produced by VPS and HVOF processes in accordance with this invention is lower than that obtained by APS processes. For example, the oxide content of the bond coat 16 has been determined to be not more than 3 volume percent if applied by HVOF, and less if applied by VPS, whereas the oxide content of an APS bond coat is usually more than 5 volume percent. Preferably, the deposition process also partially melts the coarser powder to achieve bonding between the finer and coarser particles. Following deposition, the bond coat 16 preferably undergoes heat treatment to enhance diffusion bonding between the particles of the two powders and bonding between the bond coat 16 and the substrate 12. A suitable heat treatment is to subject the bond coat 16 to a temperature of about 950° C. to about 1150° C. for a duration of about one to six hours in a vacuum or inert atmosphere.

Bond coats formed by the VPS and HVOF processes of this invention have been successfully produced and tested on specimens of a nickel-base superalloy. Bond coats of the VPS coated specimens were formed using two CoNiCrAlY powders, one having a particle size distribution of about 5 to about 37 μm, the second having a particle size distribution of about 44 to about 89 μm. While the metal powders used had the same metallic composition, it is within the scope of this invention to use powders of different compositions. The finer and coarser powders were deposited by VPS onto the specimens at a ratio of about 5:8. The process parameters used to deposit the powder mixture included an arc current of about 1450 to 1850 amps, a power level of about 40 to 70 kW, and a vacuum of 10 to 60 torr or an inert gas backfill of less than 600 torr. Bond coats of the HVOF coated specimens were also formed using two powders of the same CoNiCrAlY alloy, one having a particle size distribution of about 22 to about 44 μm, the second having a particle size distribution of about 44 to about 89 μm. The finer and coarser powders were deposited by HVOF onto the specimens at a ratio of about 5:8. The process parameters used to deposit the powder mixture included a hydrogen gas flow of about 1400 to 1700 standard cubic feet per hour (scfh), an oxygen gas flow of about 300 to 500 scfh, and a nitrogen gas flow of about 500 to 900 scfh. All of the specimens were then heat treated at about 1080° C. for a duration of about four hours in a vacuum atmosphere. Following heat treatment, the VPS bond coats were characterized by a surface roughness of about 470 to 590 microinches Ra, a density of about 99% of theoretical, and an oxide content of less than about 0.2 volume percent. The HVOF bond coats were characterized by a surface roughness of about 420 to 600 microinches Ra, a density of about 97% of theoretical, and an oxide content of about 2 volume percent.

Furnace cycle tests were then performed on each of the VPS specimens prepared in accordance with this invention and on baseline specimens processed identically but for the bond coats being formed using a CoNiCrAlY powder that was deposited conventionally by APS. The VPS specimens were processed to have a bond coat formed of two layers, each having a thickness of about 150 micrometers, with the inner layer formed by the finer powder and the outer layer consisting of a 5:8 mixture of the finer and coarser powders. The APS specimens were formed to have a bond coat thickness of about 150 micrometers. All specimens were overcoated with a thermal-insulating ceramic layer having a thickness of about 380 micrometers.

The test consisted of 45 minute cycles at 1095° C., 20 hour cycles at 1095° C., and 45 minute cycles 1035° C. The results of the furnace cycle tests are summarized below.

| SPECIMEN | 45 MIN. @ 1095° C. | 20 HRS. @ 1095° C. | 45 MIN. @ 1035° C. |
|---|---|---|---|
| APS bond coat | 273 hrs. | 760 hrs. | 1403 hrs. |
| VPS bond coat | 518 hrs. | 1220 hrs. | 1508 hrs. |

The above data evidence the superiority of the VPS bond coats produced by this invention over the prior art APS bond coats, and that the superiority of the VPS bond coat becomes more apparent with increased temperatures and longer exposures. Post-test examination showed that the aluminum in the superalloy near the bond coat-substrate interface was depleted in the APS specimens, while the superalloy substrate was completely protected in the VPS specimens.

While the invention has been described in terms of a preferred embodiment, it is apparent that other forms could be adopted by one skilled in the art, such as by substituting other materials for the substrate, bond coat and thermal-insulating layers of the coating system, or by employing the resulting coating system in applications other than those noted. Therefore, the scope of the invention is to be limited only by the following claims.

What is claimed is:

1. A method comprising the steps of:

providing a superalloy substrate; and forming a bond coat on the substrate by depositing metal powders on the substrate using a deposition technique chosen from the group consisting of vacuum plasma spraying and high velocity oxy-fuel spraying, the metal powders comprising first and second powders of oxide scale-forming metal alloys, the first and second powders having different particle size distributions such that the first powder has a smaller average particle size than the second powder, the bond coat being characterized by a surface roughness of at least about 350 microinches that is attributable to particles of the second powder being incompletely melted during deposition.

2. A method as recited in claim 1, wherein the deposition technique entails fully melting the particles of the first powder.

3. A method as recited in claim 1, further comprising the step of heat treating the bond coat to diffusion bond particles of the first and second powders.

4. A method as recited in claim 1, wherein the step of forming the bond coat entails sequentially depositing the first powder and then a mixture of the first and second powders on the substrate.

5. A method as recited in claim 1, wherein the step of forming the bond coat entails simultaneously depositing the first and second powders on the substrate.

6. A method as recited in claim 1, wherein the first powder constitutes by volume about 20 to about 80 percent of the bond coat.

7. A method as recited in claim 1, wherein the first powder has a particle size distribution of about 5 to about 45 $\mu$m.

8. A method as recited in claim 1, wherein the second powder has a particle size distribution of about 45 to about 120 $\mu$m.

9. A method as recited in claim 1, wherein each of the oxide scale-forming metal alloys is selected from the group consisting of aluminum-containing intermetallics, chromium-containing intermetallics, and combinations thereof.

10. A method as recited in claim 1, further comprising the step of plasma spraying a thermal-insulating layer on the bond coat.

11. A method for forming a thermal barrier coating system, the method comprising the steps of:

providing a superalloy substrate;

forming a bond coat on the substrate by sequentially depositing a first powder and then a mixture of the first powder and a second powder on the substrate using a deposition technique chosen from the group consisting of vacuum plasma spraying and high velocity oxy-fuel, the first and second powders each comprising particles of aluminum-containing alloys, the first and second powders having different particle size distributions such that at least 90 percent of the particles of the first powder are smaller than particles of the second powder, the first powder constituting by volume about 20 to about 80 volume percent of the first and second powders deposited on the substrate, the bond coat being characterized by a surface roughness of at least about 350 microinches that is attributable to particles of the second powder being incompletely melted during deposition, the bond coat being characterized by a density of at least about 95% of theoretical density;

heat treating the bond coat to diffusion bond the particles of the first and second powders and bond the bond coat to the substrate; and plasma spraying a thermal-insulating layer on the bond coat.

12. A method as recited in claim 11, wherein the deposition technique entails fully melting the particles of the first powder.

13. A method as recited in claim 11, wherein the heat treating step is performed at a temperature of about 950° C. to about 1150° C. for a duration of about one to about six hours.

14. A method as recited in claim 11, wherein the first powder has a particle size distribution of about 5 to about 45 $\mu$m.

15. A method as recited in claim 11, wherein the second powder has a particle size distribution of about 45 to about 120 $\mu$m.

16. A method as recited in claim 11, wherein each of the aluminum-containing alloys is an aluminum-containing intermetallics.

* * * * *